US006780004B2

(12) United States Patent
Katefidis

(10) Patent No.: US 6,780,004 B2
(45) Date of Patent: Aug. 24, 2004

(54) THERMAL POST-COMBUSTION DEVICE

(75) Inventor: Apostolos Katefidis, Gärtringen (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 10/222,664

(22) Filed: Aug. 16, 2002

(65) Prior Publication Data

US 2004/0033459 A1 Feb. 19, 2004

(51) Int. Cl.[7] ..... F23M 9/00; F23C 7/00

(52) U.S. Cl. ..... 431/116; 431/9; 431/183; 431/353

(58) Field of Search ..... 431/115, 116, 431/9, 182, 183, 187, 353, 82

(56) References Cited

U.S. PATENT DOCUMENTS

| | | | | | |
|---|---|---|---|---|---|
| 1,235,855 | A | * | 8/1917 | Stillman | 239/402 |
| 2,497,480 | A | * | 2/1950 | Walshin | 239/403 |
| 2,796,923 | A | * | 6/1957 | Fiske et al. | 431/183 |
| 2,857,961 | A | * | 10/1958 | Brown et al. | 431/116 |
| 2,918,117 | A | * | 12/1959 | Griffin | 431/116 |
| 3,748,853 | A | * | 7/1973 | Jones et al. | 60/737 |
| 4,240,784 | A | * | 12/1980 | Dauvergne | 431/351 |
| 4,380,429 | A | * | 4/1983 | LaHaye et al. | 431/115 |
| 4,561,841 | A | * | 12/1985 | Korenyi | 431/265 |
| 4,725,223 | A | * | 2/1988 | Coppin et al. | 431/243 |
| 4,845,940 | A | * | 7/1989 | Beer | 60/732 |
| 5,369,679 | A | * | 11/1994 | Sliski et al. | 378/65 |
| 5,388,985 | A | * | 2/1995 | Musil et al. | 431/116 |
| 5,490,775 | A | * | 2/1996 | Joshi et al. | 431/187 |
| 5,540,213 | A | * | 7/1996 | Shell et al. | 126/110 B |
| 5,961,315 | A | * | 10/1999 | Haumann et al. | 431/115 |
| 6,065,957 | A | * | 5/2000 | Kondo et al. | 431/116 |
| 6,093,018 | A | * | 7/2000 | Avshalumov | 431/352 |
| 6,102,687 | A | * | 8/2000 | Butcher et al. | 431/115 |
| 6,106,276 | A | * | 8/2000 | Sams et al. | 431/114 |
| 6,145,450 | A | * | 11/2000 | Vatsky | 110/265 |
| 6,386,863 | B1 | * | 5/2002 | Sarv et al. | 431/184 |
| 2002/0076669 | A1 | * | 6/2002 | Riepenhoff et al. | 431/354 |

FOREIGN PATENT DOCUMENTS

| | | | | |
|---|---|---|---|---|
| CH | 591 656 | | 9/1977 | |
| DE | 30 43 286 | C2 | 6/1982 | |
| DE | 695 15 109 | T2 | 7/2000 | |
| EP | 421903 | A2 * | 4/1991 | F23C/7/00 |
| EP | 674134 | A1 * | 9/1995 | F23C/7/00 |
| GB | 2094464 | A * | 9/1982 | F23R/3/58 |
| JP | 62000762 | A * | 1/1987 | F24H/1/24 |

* cited by examiner

*Primary Examiner*—Ira S. Lazarus
*Assistant Examiner*—James G. Barrow
(74) *Attorney, Agent, or Firm*—Factor & Lake

(57) ABSTRACT

A thermal post-combustion device for the purification of exhaust air comprises an outer housing surrounded by an insulating jacket, a combustion chamber bounded by a combustion chamber housing and arranged within the outer housing, and a burner chargeable with fuel and that comprises a burner nozzle and a first flame tube that surrounds the burner nozzle and connects the space between the outer housing and the combustion chamber housing to the combustion chamber. The burner includes at least one further flame tube that is arranged completely within the combustion chamber, and the end of the first flame tube lying inside the combustion chamber is surrounded by a further flame tube of larger radius so as to form an annular gap between the first flame tube and the further flame tube. In this way a circulating flow of the combustion air becomes possible inside the combustion chamber, which flow is guided repeatedly through the annular gap and the flame of the burner. This improves the completeness of the combustion and produces a uniform temperature within the combustion chamber, with the result that the post-combustion device can be operated at a lower flame temperature.

3 Claims, 3 Drawing Sheets

THERMAL POST-COMBUSTION DEVICE

BACKGROUND OF INVENTION

The present invention relates to a thermal post-combustion device for the purification of exhaust air, comprising a) an outer housing surrounded by an insulating jacket;

b) a combustion chamber bounded by a combustion chamber housing and arranged inside the outer housing;

c) a burner chargeable with a fuel and that comprises a burner nozzle and a first flame tube that surrounds the burner nozzle and connects the space between the outer housing and the combustion chamber housing to the combustion chamber.

Thermal post-combustion devices likewise serve in the same way as regenerative post-combustion devices for the purification of industrial waste gases that contain combustible substances. Regenerative post-combustion devices are employed in particular in cases where the purified gases are to be passed at as low a temperature as possible directly to a flue and the energy efficiency should be as high as possible so that the combustion process proceeds without the addition of external energy. This takes place through a relatively complicated heat exchange between the fed exhaust air and discharged purified combustion air.

Thermal post-combustion devices on the other hand employ a so-called "surface burner" for the combustion of the impurities entrained in the exhaust air, to which burner external energy is fed in the form of fuel. These surface burners operate without fans and extract the oxygen required for the combustion from the exhaust air to be purified, which is supplied under pressure. Also, thermal post-combustion devices generally comprise a heat exchanger in which heat is extracted from the combustion gases so that the latter flow out at a lower temperature; some of the heat is fed to the exhaust air to be purified, with the result that this is introduced already preheated into the actual combustion process. In general process heat is extracted from a thermal post-combustion device for use in another heat-consuming procedure taking place adjacent thereto, e.g. for heating purposes.

With the known thermal post-combustion devices available on the market of the type mentioned in the introduction, the burner has only a single flame tube, through which the exhaust air to be treated is introduced into the combustion chamber and fed to the flame generated by the burner nozzle. Since hot and cold air do not readily mix, with these known thermal post-combustion devices the complete combustion of all impurities is complicated despite the use of air vortexing means, with the result that higher flame temperatures have to be used for the combustion. This is associated with a threefold disadvantage: on the one hand the energy consumption is high. Secondly, materials that can withstand relatively high temperatures have to be used in the device and, finally, more undesirable nitrogen oxides are formed due to the high flame temperature.

The object of the present invention is to modify a thermal post-combustion device so that a complete combustion of the impurities in the exhaust air takes place already at relatively low flame temperatures.

This object is achieved according to the invention if d) the burner has at least one further ("second") flame tube that is arranged completely within the combustion chamber and the end of the first flame tube lying within the combustion chamber is surrounded by the further flame tube of larger radius so that an annular gap is formed between the first flame tube and the further flame tube.

The design of the burner according to the invention permits a circulating flow within the combustion chamber itself, the circulating flow passing through the gap between the first flame tube and the second/further flame tube and being assisted by the suction effect generated by the gas flow streaming through the inner flame tube. The exhaust air to be treated accordingly does not pass through the combustion chamber in a single passage, but is guided, possibly several times, through the flame of the burner nozzle before it finally leaves the combustion chamber in the direction of the heat exchanger. The circulating flow confers several benefits: there is a better air vortexing and thus mixing of cold and hot air streams, which improves the combustion. All the regions of the whole combustion chamber are heated uniformly. A complete combustion is ensured due to the multiple passage of the combustion gases through the flame. Overall it is thereby possible to reduce the flame temperature without impairing the complete combustion. Tests have shown that considerable energy savings of up to 10% may thereby be obtained. Also, cheaper materials may be employed for the various structural elements of the thermal post-combustion devices since they are not exposed to such high temperatures.

Particularly preferred is that modification of the invention in which a deflection means is provided spaced from the outlet opening of the further flame tube in the radially outer region of the combustion chamber, which device redeflects combustion air incident on the latter along the wall of the combustion chamber housing in the direction of the annular gap between the first flame tube and further flame tube. The deflection means thus assists the circulating flow mentioned above since it prevents the greater part of the air from already leaving the combustion chamber during its first passage through the flame.

It is furthermore convenient if the burner nozzle comprises a nozzle housing provided with passage openings and a fuel channel that has, in the region adjacent to the outlet opening, a venturi-like cross-sectional profile. The flow velocity of the fuel can be increased by this venturi-like cross-sectional profile and foreign gases can be aspirated through the passage openings of the nozzle housing so that the energy content of the fuel is reduced by "dilution". The result is a flame of lower temperature that produces fewer nitrogen oxides. Also, the generated flame is broadened in the radial direction due to the acceleration of the fuel. This facilitates the introduction into the flame of the air flowing through the first flame tube and possibly through the air vortexing means located in the latter.

BRIEF DESCRIPTION OF THE DRAWINGS

One embodiment of the invention is described in more detail hereinafter with the aid of the drawings, in which.

DETAILED DESCRIPTION OF THE DRAWINGS

Figure 1:
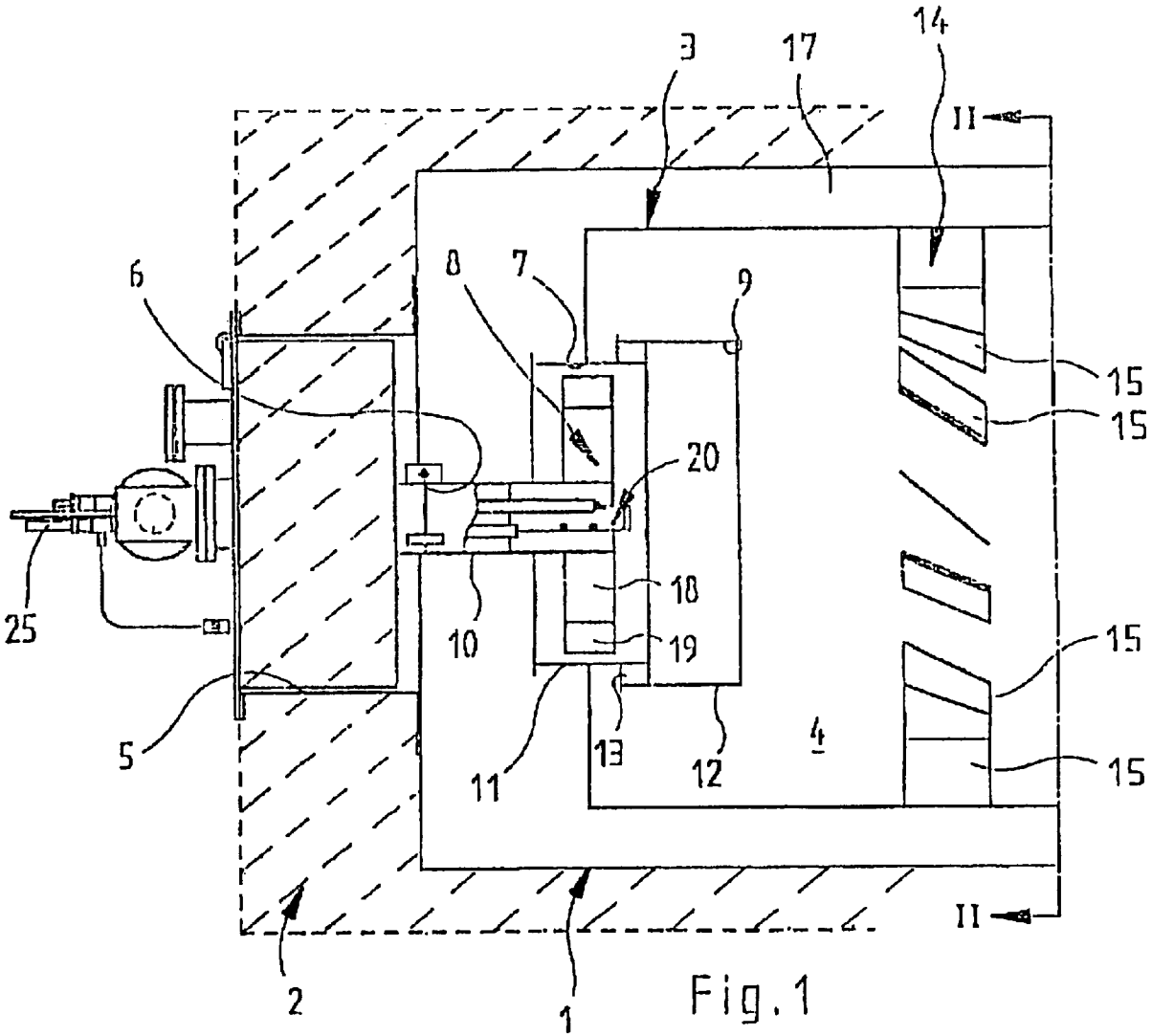
FIG. 1 is an axial section along line 1—1 of FIG. 2 through the region in the vicinity of the burner of a thermal post-combustion device.

While this invention is susceptible of embodiment in many different forms, there is shown in the drawings and will be described in detail, one specific embodiment with the understanding that the present disclosure is to be considered as an exemplification of the principles of the invention and is not intended to limit the invention to the embodiment illustrated.

Figure 2:
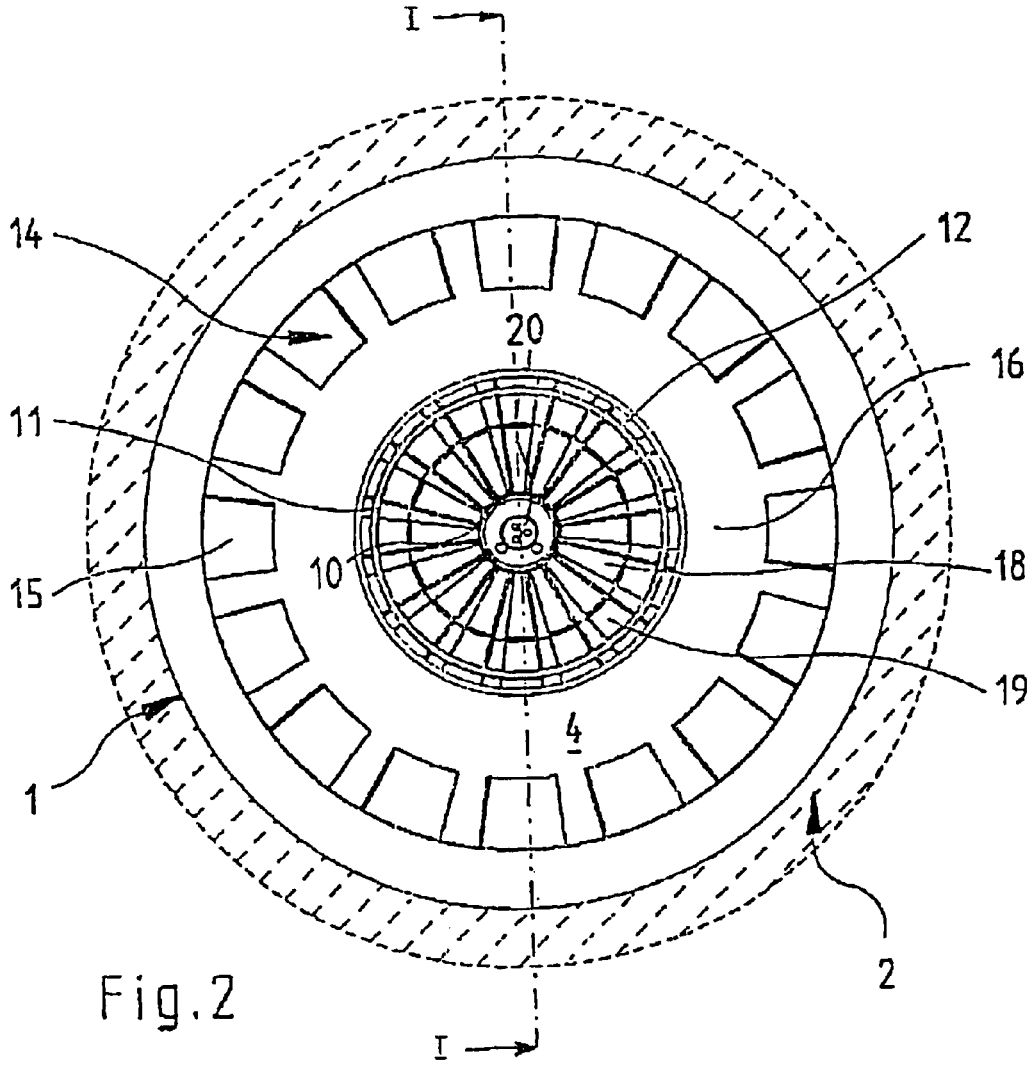
FIG. 2 is a section along line II—II of FIG. 1.

As FIGS. 1 and 2 show, the illustrated thermal post-combustion device comprises an outer housing 1 that is surrounded by an insulating jacket 2 shown only diagrammatically. A combustion chamber 4, which is bounded by a combustion chamber housing 3, is located within the outer housing 1. A burner, which is identified overall by the reference numeral 8 and whose outlet opening 9 terminates in the combustion chamber 4, is inserted through an opening 5 in the insulating jacket 2, through an opening 6 in the outer housing 1, and through an opening 7 in the combustion chamber housing 3.

Figure 4:
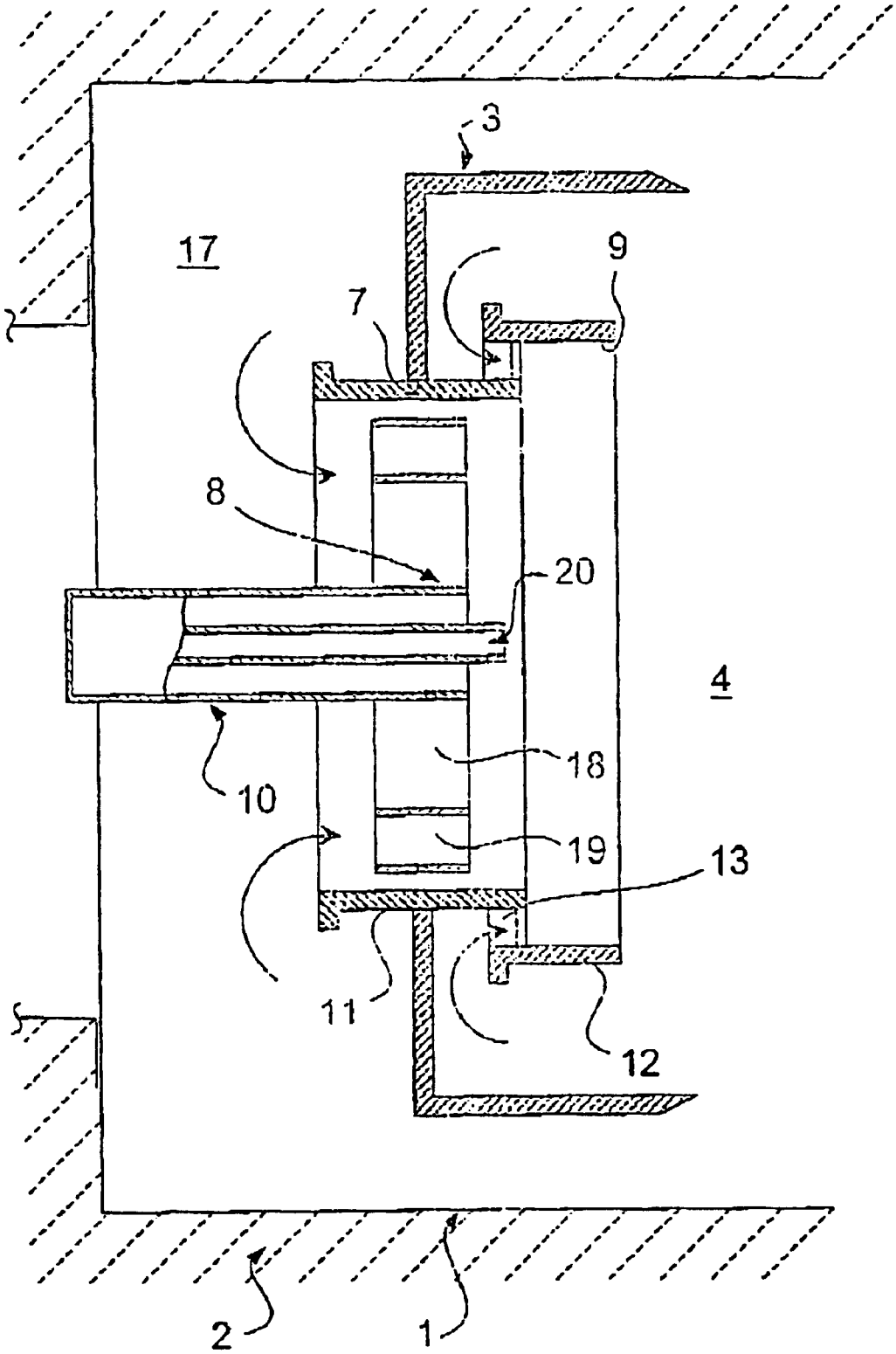
FIG. 4 shows an enlarged sectional view of the region in the vicinity of the burner of FIG. 1.

As best seen in FIG. 4, the burner 8 comprises a cylindrical burner housing 10 and a first, cylindrical flame tube 11 that is inseted into the opening 7 of the combustion chamber housing 3, as well as a second flame tube 12 coaxially aligned to the burner housing 10 and the first flame tube 11. This second flame tube is displaced axially relative to the first flame tube 11 in the direction of the interior of the combustion chamber 4 and has a larger diameter than the first flame tube 11, with the result that an annular gap 13 extending coaxially with respect to the flame tubes 11, 12 is formed in an overlapping region the two flame tubes 11, 12.

A deflection device that is identified overall by the reference numeral 14 is installed, axially spaced from the outlet opening 9 of the burner 8, on the inner jacket surface of the combustion chamber housing 3. This deflection device consists of a plurality of blades 15 that are mounted at an acute angle with respect to the axis of the combustion chamber housing 3 and that optionally have a certain degree of torsion. A substantially freely traversible space 16 remains radially within the deflection means 14, as can be seen in particular from FIG. 2.

At the right-hand end of the combustion chamber 4, which is no longer shown in the drawing, a heat exchanger is connected in a known manner, through which flows combustion gas generated in the combustion chamber 4, on its path to the outlet. Also not shown is the inlet for the exhaust air to be treated, which communicates via the aforementioned heat exchanger with the space 17 lying between the outer housing 1 and the combustion chamber housing 3.

The burner housing 10 carries on its outer jacket surface at the inner end two coaxial rows of air vortexing blades 18, 19, which are arranged at uniform angular interspacings over the whole circumference at an angle to the axis of the burner and are in addition tensioned, in a manner known per se.

Figure 3:
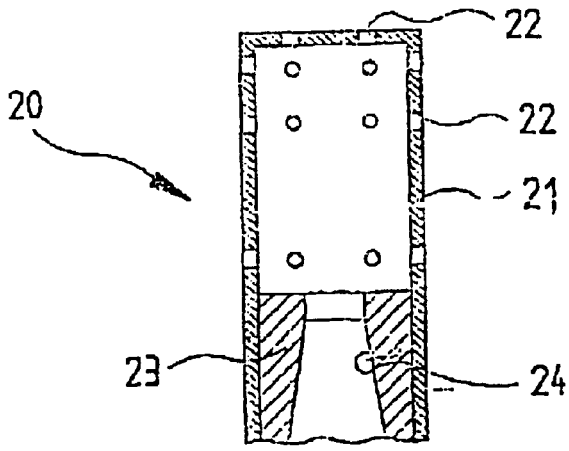
FIG. 3 is an axial section on an enlarged scale through the burner nozzle of the thermal post-combustion device of FIG. 1.

A burner nozzle 20, part of which is highlighted in FIG. 3 in an axial section and on an enlarged scale, extends through the burner housing 10. The nozzle housing 21, which is cylindrical and is sealed at the internally lying end, is provided with a plurality of passage openings 22 in the jacket surface as well as in the front surface of the nozzle housing 21. A nozzle insert 23 is mounted and secured in the interior of the nozzle housing 21, and has a fuel channel 24 tapering in the manner of a venturi tube in the direction of the front surface of the burner housing 20. The fuel channel 24 communicates with a fuel inlet 25 located outside the insulating jacket 2.

The thermal post-combustion device described above operates as follows:

The exhaust air to be treated is, as already mentioned above, introduced via the inlet (not shown in the drawing) into the heat exchanger (likewise not shown), where it is heated up. The exhaust air then flows through the space 17 between the outer housing 1 and combustion chamber housing 3 to the annular inlet opening of the first flame tube 11, which is bounded at its radially inner-lying edge by the burner housing 10. From here on the air flows axially through the first flame tube 11 and is caused to execute a vortex motion by the air vortexing blades 18 and 19. Following its further axial flow through the second flame tube 12 the air reaches the region of the flame generated by the burner nozzle 20. The impurities contained in the exhaust air are combusted and thereby rendered harmless.

The air vortex generated by the air vortexing blades 18, 19 expands in the form of a cone with increasing distance from the outlet opening 9 and its main volume strikes the deflection device 14; only a certain proportion of the combustion air flows through the free space 16 and thence via the heat exchanger, where its heat is extracted, to the outlet of the thermal post-combustion device.

The greater part of the combustion air on the other hand is deflected towards the left by the deflection means 14, along the wall of the combustion chamber housing 3 in FIG. 1 and reaches the annular gap 13 between the first flame tube 11 and the second flame tube 12. The combustion air is sucked through this annular gap 13 and in this way reaches once more the region of the flame generated by the burner nozzle 20, so that a renewed combustion of combustible impurities that may still be present takes place. A circulating flow is generated in this way within the combustion chamber 4, which depending on the circumstances flows repeatedly over the deflection means 14 and through the annular gap 13 between the first flame tube 11 and the second flame tube 12. The overall result is a substantially improved purification of the exhaust air, which moreover may take place at lower temperatures and is associated with considerable energy savings and furthermore with a lesser production of nitrogen oxides. The temperature distribution is very largely homogeneous inside the combustion chamber 4; in particular, the regions of the combustion chamber 4 adjacent to the combustion chamber housing 3 are also heated up to a greater extent than was the case with known thermal post-combustion devices.

The fuels fed via the fuel channel 24 to the burner nozzle 20 are accelerated inside the said burner nozzle 20 on account of the venturi-like tapering of the fuel channel 24. As a result air is sucked in, especially at the passage openings 22 of the nozzle housing 21 that are adjacent to the outlet opening of the fuel channel 24. This additional air leads to a reduction of the energy density of the fuel, with the result that the combustion takes place at a lower temperature. The acceleration of the fuel by means of the venturi-like tapering in the fuel channel 24 also leads to a radial expansion of the generated flame. In this way the exhaust air flowing through the air vortexing blades 18, 19 can be introduced more efficiently into the flame for the post-combustion of the impurities.

Gas was used as fuel in the embodiment of a thermal post-combustion device described above. It is obviously also possible to replace the gas burner nozzle 20 by an oil atomiser nozzle.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. Thermal post-combustion device for the purification of exhaust air, comprising a) an outer housing surrounded by an insulating jacket;

b) a combustion chamber bounded by a combustion chamber housing and arranged inside the outer housing;

c) a burner chargeable with a fuel and that comprises a burner nozzle and a first flame tube surrounds the burner nozzle and connects the combustion chamber to a space which is disposed between the outer housing and the combustion chamber housing, characterized in that d) the burner has at least one second flame tube that is arranged completely within the combustion chamber and the end of the first flame tube lying within the combustion chamber is surrounded by the second flame tube of larger radius so that an annular gap is formed between the first flame tube and the second flame tube.

2. Thermal post-combustion device according to claim 1, characterized in that a deflection means is provided spaced from an outlet opening of the further flame tube in the radially outer region of the combustion chamber, which deflection device redeflects combustion air incident thereon along the wall of the combustion chamber housing in the direction of the gap between the first flame tube and second flame tube.

3. Technical post-combustion device according to claim 1 or 2, characterized in that the burner nozzle has a nozzle housing provided with passage openings and a fuel channel that has, in the region adjacent to the outlet opening, a venturi-like cross-sectional profile.

* * * * *